US005818433A

United States Patent [19]

Sherburne

[11] Patent Number: 5,818,433

[45] **Date of Patent: *Oct. 6, 1998**

[54] GRAPICS MEMORY APPARATUS AND METHOD

[75] Inventor: Robert Sherburne, Kentfield, Calif.

[73] Assignee: Silicon Graphics, Inc., Mountain View, Calif.

[ * ] Notice: The term of this patent shall not extend beyond the expiration date of Pat. No. 5,585,824.

[21] Appl. No.: 708,896

[22] Filed: Sep. 5, 1996

Related U.S. Application Data

[63] Continuation of Ser. No. 259,572, Jun. 14, 1994, Pat. No. 5,585,824, which is a continuation of Ser. No. 733,313, Jul. 22, 1991, abandoned.

[51] Int. Cl.[6] ..... G09G 5/00

[52] U.S. Cl. ..... 345/203; 345/516; 345/197

[58] Field of Search ..... 345/185, 200, 345/203, 197, 507, 516, 508, 509; 395/507, 508, 509

[56] References Cited

U.S. PATENT DOCUMENTS

| | | | |
|---|---|---|---|
| 4,200,869 | 4/1980 | Murayama et al. | 345/200 |
| 4,492,983 | 1/1985 | Yoshida et al. | 358/260 |
| 4,772,881 | 9/1988 | Hannah | 345/153 |
| 4,808,986 | 2/1989 | Mansfield et al. | 345/133 |
| 4,857,901 | 8/1989 | Lathrop | 345/199 |
| 4,972,359 | 11/1990 | Silver et al. | 364/728.05 |
| 5,029,112 | 7/1991 | Sakamoto et al. | 364/521 |
| 5,058,041 | 10/1991 | Rose et al. | 364/521 |
| 5,170,251 | 12/1992 | Levy | 345/200 |
| 5,204,664 | 4/1993 | Hamakawa | 345/199 |
| 5,231,383 | 7/1993 | Diepstraten et al. | 345/200 |
| 5,261,049 | 11/1993 | Lumelsky | 345/164 |
| 5,274,364 | 12/1993 | Li et al. | 345/118 |
| 5,351,067 | 9/1994 | Lumelsky | 345/191 |
| 5,420,608 | 5/1995 | Choi et al. | 345/186 |
| 5,430,464 | 7/1995 | Lumelsky | 345/191 |
| 5,457,482 | 10/1995 | Rhoden et al. | 345/201 |
| 5,585,824 | 12/1996 | Sherburne | 345/203 |

FOREIGN PATENT DOCUMENTS 56-143485 11/1981 Japan .

*Primary Examiner*—Amare Mengistu
*Attorney, Agent, or Firm*—Blakely, Sokoloff, Taylor & Zafman

[57] ABSTRACT

A graphics memory apparatus and methods for the organization, storage and playback of graphics data for display purposes. The image data and overlay data (and/or other graphics data) are organized and stored in the graphics memory in an interleaved fashion so that only one type of graphics data is stored at any one memory address (pixel data or overlay data or other graphics data) and so that preferably full memory capacity is utilized for the area of graphics memory employed. As an example, in a system for displaying eight bits of color image data and two bits of overlay, the overlay data is interleaved with the image data so that four consecutive address locations will contain image data, with preceding or following address location containing the associated overlay data. Therefore, such organization can result in graphics memory efficiency, reduced bandwidth requirements therefor and increased speed with which the contents or portions thereof may be loaded, altered, etc. Apparatus and methods for practicing the invention are disclosed.

15 Claims, 5 Drawing Sheets

FIG. 3A (Prior Art)

Memory Cycle

| | 2 | 1 | 0 | |
|---|---|---|---|---|
| | PIX6 | PIX3 | PIX0 | 8 |
| | PIX7 | PIX4 | PIX1 | 8 |
| ... | PIX8 | PIX5 | PIX2 | 8 |
| | OL6 | OL3 | OL0 | 2 |
| | OL7 | OL4 | OL1 | 2 |
| | OL8 | OL5 | OL2 | 2 |
| | | | | 2 |

t 0 $\overline{32}$

FIG. 3B (Prior Art)

Displayed Pixels

| | 3 | 2 | 1 | 0 |
|---|---|---|---|---|
| ... | PIX3 | PIX2 | PIX1 | PIX0 |
| | OL3 | OL2 | OL1 | OL0 |

Memory Cycle

| | 4 | 3 | 2 | 1 | 0* | |
|---|---|---|---|---|---|---|
| | PIXC | PIX8 | PIX4 | PIX0 | OL0-3 | 8 |
| ... | PIXD | PIX9 | PIX5 | PIX1 | OL4-7 | 8 |
| | PIXE | PIXA | PIX6 | PIX2 | OL8-B | 8 |
| | PIXF | PIXB | PIX7 | PIX3 | OLC-F | 8 |

t 0

Displayed Pixels

| | 3 | 2 | 1 | 0 | |
|---|---|---|---|---|---|
| ... | PIX3 | PIX2 | PIX1 | PIX0 | 8 |
| | OL3 | OL2 | OL1 | OL0 | 2 |

t 0

FIG. 7A

Memory Cycle

| 2 | 1 | 0 | |
|---|---|---|---|
| PIXA | PIX5 | PIX0 | 8 |
| PIXB | PIX6 | PIX1 | 8 |
| PIXC | PIX7 | PIX2 | 8 |
| PIXD | PIX8 | PIX3 | 8 |
| PIXE | PIX9 | PIX4 | 8 |
| OLA | OL5 | OL0 | 4 |
| OLB | OL6 | OL1 | 4 |
| OLC | OL7 | OL2 | 4 |
| OLD | OL8 | OL3 | 4 |
| OLE | OL9 | OL4 | 4 |
| | | | 4 |

t 0 64

FIG. 7B

Displayed Pixels

| 2 | 1 | 0 |
|---|---|---|
| PIX2 | PIX1 | PIX0 |
| OL2 | OL1 | OL0 |

t 0

FIG. 7C

Memory Cycle

| 2 | 1 | 0 |
|---|---|---|
| OL0-1 | PIX8 | PIX0 | OL0-1 |
| OL2-3 | PIX9 | PIX1 | OL2-3 |
| OL4-5 | PIXA | PIX2 | OL4-5 |
| OL6-7 | PIXB | PIX3 | OL6-7 |
| OL8-9 | PIXC | PIX4 | OL8-9 |
| OLA-B | PIXD | PIX5 | OLA-B |
| OLC-D | PIXE | PIX6 | OLC-D |
| OLE-F | PIXF | PIX7 | OLE-F |

t 0

FIG. 7D

Displayed Pixels

| 2 | 1 | 0 |
|---|---|---|
| PIX2 | PIX1 | PIX0 |
| OL2 | OL1 | OL0 |

t 0

GRAPICS MEMORY APPARATUS AND METHOD

This is a continuation of application Ser. No. 08/259,572, filed Jun. 14, 1994 now U.S. Pat. No. 5,585,829, which is a continuation of application Ser. No. 07/733,313, filed Jul. 22, 1991.(now Abandoned)

BACKGROUND OF THE INVENTION

1. Field of the Invention

The present invention relates to the field of digital image storage and display systems.

2. Prior Art

In prior art digital image storage and display systems, the information for each pixel in the image to be displayed is stored sequentially in digital form, and for display purposes is repetitively read out in synchronism with a raster scan display device so as to repetitively redraw the desired image on the display screen. In the case of a simple black and white image wherein each pixel is to be displayed either as black or white, but no of grey shades therebetween, only a single bit of storage is required for each pixel location. Since the digital information is generally stored in the order in which the pixels are displayed, one can relate an "area" (address range) of memory space with the corresponding two dimensional image or image area being displayed. Because only a single bit is required to represent each pixel, the memory area is referred to as a memory plane, in essence corresponding to the planar area of the image itself.

If on the other hand, one also desired not only black or white, but two grey shades therebetween, a second memory plane may be added, covering the same address range as the first memory plane. Now each bit in any memory location in the first memory plane has associated therewith a corresponding bit at the same location in the second memory plane, so that the two will be addressed and processed simultaneously and used together to determine white, black or appropriate grey shade. In general, one might use, for instance, eight bits per pixel for a relatively fine control of grey shade, in which case there would be eight memory planes, all simultaneously addressed to bring up the information for display. (While the information is displayed pixel by pixel, an eight bit wide memory organization will bring up information for eight bits at a time on each fetch, a sixteen bit wide memory for sixteen pixels at a time, etc.) In general, these memory planes can be equated to image planes in the sense that generally in an eight bit grey scale value for each pixel, the most significant bit will have the most contribution to the grey shade, the next significant bit providing half the contribution of the most significant bit, etc., with the least significant bit providing only a fine adjustment of the general grey shade determined by all of the more significant bits. In this sense, each memory plane defines a two dimensional image contribution which in theory may be displayed alone and which when displayed with the contribution of the other memory planes will provide the grey shade image as desired.

In the case of color images, there are a number of data formats. One such format, referred to as RGB, is based on mixing three primary colors, each controlled in intensity to provide the colors and shades desired. In such a format, certain bits are assigned for control of red, certain bits for the control of green and certain bits for the control of blue, each color being controlled substantially the same as one would control a corresponding grey shade image.

Also in the prior art, additional memory planes are frequently provided for other purposes. By way of example, one or more planes may be provided to provide a grid or other overlay over an image. For instance, in a color system, two bits of overlay might be used, so that for each pixel location on the image, either the respective image pixel will be displayed or an overlay pixel will be displayed dependent upon the two bits of overlay information stored at the corresponding memory location in the overlay memory planes. Typically, any non-zero two bit code for any pixel location will cause an override of the pixel data by the overlay data, with the three variations of non-zero overlay data for the pixel location determining the color of the overlay pixel, whereas a zero in each overlay plane for that pixel location would not affect the direct display of the image pixel data. Similarly, additional memory planes may also be provided which define a clip mask, an underlay, the color display mode (RGB or other format) for that pixel, etc. These memory planes too are simultaneously addressed with the corresponding image planes, so that all data defining a pixel, or a plurality of pixels dependent upon the width of the display memory, are simultaneously available and clocked out pixel by pixel to define each pixel in the image.

As shall subsequently be seen, the present invention departs from this typical organization, and can provide various advantages with respect to memory utilization, memory bandwidth requirements and speed of changing such things as an overlay.

BRIEF SUMMARY OF THE INVENTION

A graphics memory apparatus and methods for the organization, storage and playback of graphics data for display purposes. The image data and overlay data (and/or other graphics data) are organized and stored in the graphics memory in an interleaved fashion so that only one type of graphics data is stored at any one memory address (pixel data or overlay data or other graphics data) and so that preferably full memory capacity is utilized for the area of graphics memory employed. As an example, in a system for displaying eight bits of color image data and two bits of overlay, the overlay data is interleaved with the image data so that four consecutive address locations will contain image data, with preceding or following address location containing the associated overlay data. Therefore, such organization can result in graphics memory efficiency, reduced bandwidth requirements therefor and increased speed with which the contents or portions thereof may be loaded, altered, etc. Apparatus and methods for practicing the invention are disclosed.

BRIEF DESCRIPTION OF THE DRAWINGS

FIGS. 1, 2 and 3*a* and 3*b* illustrate a typical prior art memory organization for the refresh memory of a raster scan display system.

FIGS. 7*a* and 7*b* illustrate the memory contents and display sequence for a prior art memory organization for a refresh memory using a sixty-four bit wide memory.

FIGS. 7*c* and 7*d* illustrate the memory contents and display sequence for an embodiment of the present invention using a sixty-four bit wide memory.

DETAILED DESCRIPTION OF THE INVENTION

Figure 1:
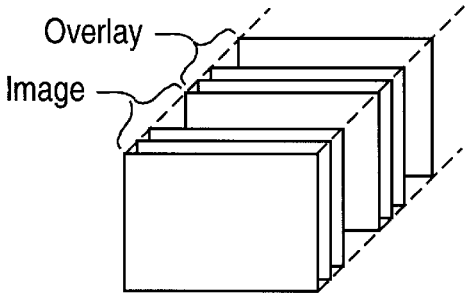
FIG. 1 (Prior Art)

First referring to FIG. 1, a prior art graphics display memory organization as hereinbefore described is illustrated. This memory organization acts as a frame buffer for the display, being organized as virtual rectangular arrays (only some of which are actually illustrated in the Figure) corresponding to a defined display region. In the Figure, both image and overlay data are illustrated, though of course, as stated before, additional planes of other display information may also be included. For purposes of specificity, a typical system may have eight bits of image data per image pixel and two bits of overlay information per pixel, with zero-zero indicating no overlay, and a non zero-zero value of overlay information defining one of three possible overlay characteristics (colors).

Figure 2:
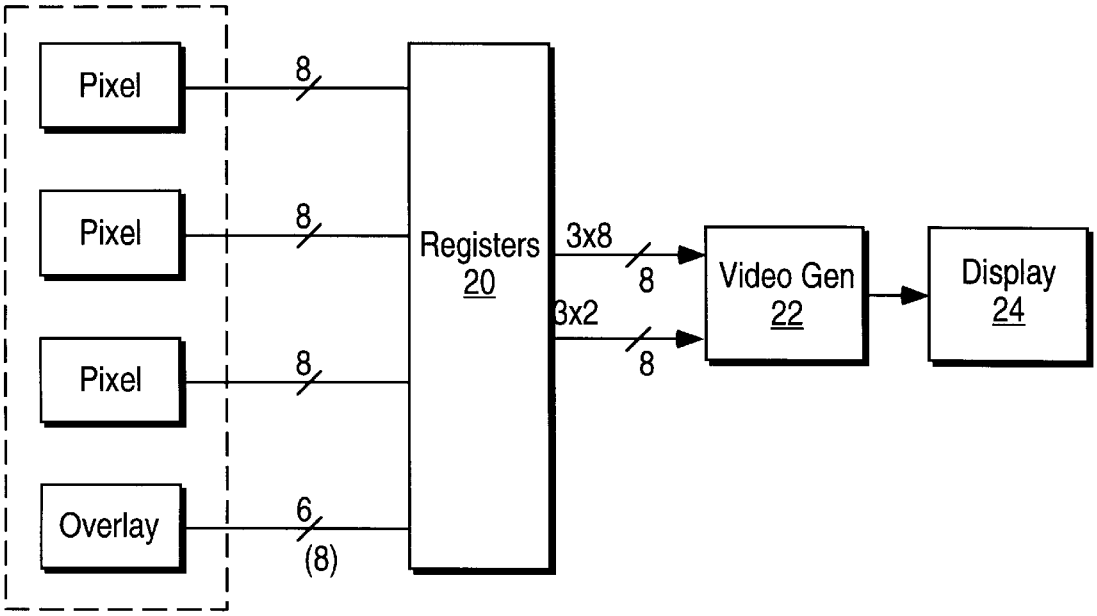
FIG. 2 (Prior Art)

A block diagram extending the prior art concept of FIG. 1 to a thirty-two bit wide memory is schematically illustrated in FIG. 2. Since on each memory fetch or memory cycle, thirty-two bits of information is retrieved, one can simultaneously retrieve pixel information for three pixels (three times eight bits of image data per pixel=twenty-four bits) and an associated two bits of overlay information for the three pixels for which image data is simultaneously being retrieved, thereby utilizing thirty of the possible thirty-two bits for the information to be displayed. The useful thirty bits of information read from memory is parallel loaded into registers 20, to be clocked out on each pixel clock cycle as eight bit image data information and two bit override information, each in parallel form to the video generator 22, which in turn serializes and combines this information to the video signals for the display 24. Accordingly, for such an organization, a memory cycle must be executed every three pixel clock cycles, with the useful information obtained consisting of thirty of the thirty-two bits addressed on each memory cycle. In this organization, each memory operation retrieves data in the same format as each other memory operation, as illustrated schematically in FIG. 3*a,* and displays the same sequentially as shown in FIG. 3*b.*

Figures 4, 5A, 5B:
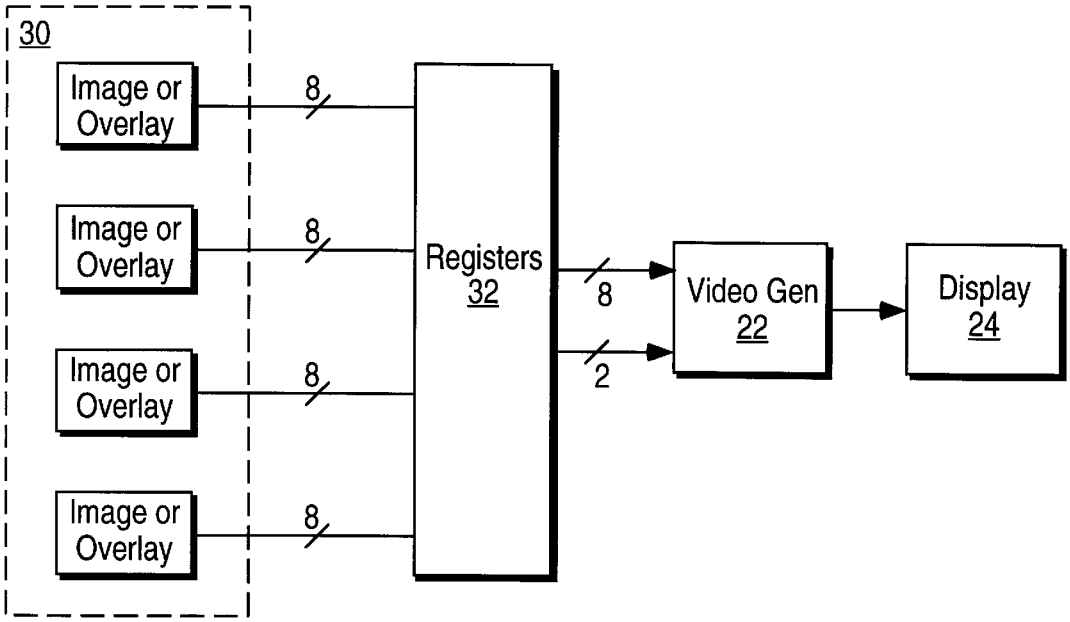
FIG. 4 is a block diagram illustrating one embodiment for the memory organization of the present invention.
FIGS. 5*a* and 5*b* illustrate the memory contents and display sequence for the embodiment of the present invention of FIG. 4.

A block diagram of the type shown in FIG. 2, but for the present invention may be seen in FIG. 4. In this Figure, the thirty-two bit data bus of the memory 30 is logically divided into four groups of eight bits and coupled to circuitry 32 which responds to the same to provide eight bit image information and two bit overlay information to the video generator 22 to provide the video information for display purposes. It will be noted in FIG. 4 that each group of eight bits is not characterized, as was done in FIG. 2, because as shall subsequently be seen in greater detail, the nature of the data in each eight bit portion of the thirty-two bit memory output will vary as to whether the same is image data or overlay data, dependent upon which memory cycle is being executed. In particular, at any one thirty-two bit memory location, either image data or overlay data is stored, but not both. Thus, if image data is stored, eight bit image data for four pixels may be stored in any thirty-two bit memory location. On the other hand, for storage of overlay data, sixteen pixels of overlay data may be stored, in both cases (image data as well as overlay data) the full thirty-two bit capability of the memory being used for storage and display purposes. Since image data for four pixels is stored at a memory address, whereas overlay data for sixteen pixels is stored at a memory address, four out of every five memory address locations are used to store the eight bit deep image data, and one out of five address locations is used to store overlay data.

This is illustrated in FIG. 5*a,* where in the beginning memory location the overlay data for sixteen pixels is stored, with the following four memory locations storing the corresponding eight bit image data for the corresponding sixteen pixels (obviously the overlay data as well as the pixel data is preferably ordered sequentially so that the same will be properly ordered when read from memory in parallel and clocked out by the pixel clock). While FIG. 5*a* shows the memory data organization for five successive memory locations, the same pattern is repeated for the entire image data and associated overlay data. Of course, whether the overlay data precedes or follows the corresponding image data or is stored at a memory location between the associated pixel data storage locations is somewhat a matter of design choice. However, it is generally preferable to have overlay data in one of the first two memory locations of each group of five and image data in the other of the first two memory locations of each group of five, as then only two memory cycles are required for each group of five before the video signal can start to be generated for that group of sixteen pixels. Of course, as before, the resulting data is converted to a video signal and sequentially displayed as shown in FIG. 5b.

Figure 6:
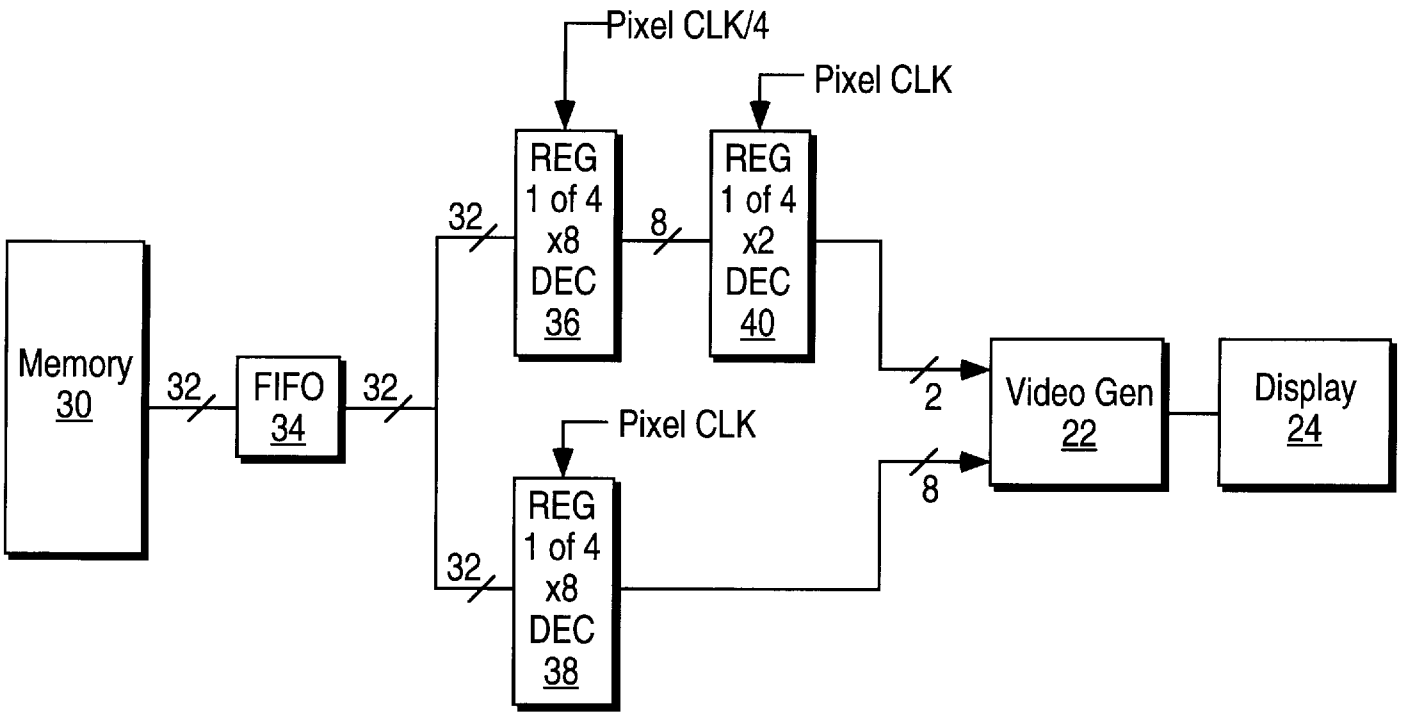
FIG. 6 illustrates in block diagram form the circuitry for utilizing the graphics data organized in accordance with FIGS. 4, 5*a* and 5*b*.

The circuitry for utilizing the graphics data organized in the manner described with respect to FIGS. 4, 5*a* and 5*b* may be seen in FIG. 6. As shown in this Figure, the thirty-two bit output of memory 30 on each memory cycle is provided to a first in, first out register (FIFO) 34, the principal function of which is to provide a data holding capability to accommodate the difference between the memory cycle clock and the pixel clock, five memory cycles being required for each sixteen pixel clock cycles. (The FIFO is not a necessity, but may relax clock timing requirements.) The thirty two bit output of the first in/first out register 34 is latched either into register-decoder 36 or register-decoder 38, dependent upon whether that particular data is overlay data or image data, respectively. The register-decoders 36 and 38 hold the thirty-two bit data and provide for the successive clocking out of each of the four eight bit segments thereof.

In the case of register-decoder 38, the clocking out of the eight bit segments is at the pixel clock rate, each eight bit segment representing the eight bit image data for the respective pixel of the image. Register-decoder 36, on the other hand, is clocked at one-fourth of the pixel clock rate, as each eight bit output thereof contains overlay data for four pixels. This output in turn is clocked into register-decoder 40 which successively selects one of the four two bit overlay data portions of the eight bit signal at pixel rate to provide the two bit overlay data in synchronism with the corresponding eight bit image data for successive pixels to the video generator 22 (used in the prior art) to generate the video signal.

Having described the general organization of the memory and memory data, and the circuitry for reading out and utilizing the same, some of the advantages of the present invention may now be illustrated. In particular, utilizing the present invention, all thirty-two bits of each memory location contain useful data, whereas in the corresponding example of the prior art, only thirty of the thirty-two bits contain useful data. This in turn means that the same rate of image information is retrieved from memory for display purposes utilizing a memory cycle which need only be fifteen-sixteenths as fast as in the prior art. This of course may also be seen by noting that information for three pixels is obtained on each memory cycle in the prior art, giving information for fifteen pixels in each five memory cycles. In the present invention however, pixel information for sixteen pixels is obtained every five memory cycles, again indicating that the present invention allows a somewhat lengthened memory cycle over the prior art for the same data display rate as in the prior art. Further, since overlay information in the present invention is confined to only selected memory locations, in the example given every fifth memory location, rather than in every memory location as in the prior art, the overlay data may be overwritten with new data, etc., at a much higher rate than in the prior art. Similarly, image data may be revised, overwritten, etc. at a somewhat higher rate than in the prior art organizations. Of course, while the organization of data in memory 30 is quite different from that of the prior art, the data therein may readily be reformatted under program control consistent with the prior art when being read out for purposes other than display, and of course, data formatted in accordance with the prior art may be readily reformatted under program control for loading into memory 30, whereby the memory format and display apparatus of the present invention may readily be made transparent to bulk storage devices, for I/O purposes, etc.

In the example, the host address to physical frame buffer address conversion is simplified. Whereas in the example of FIG. 2, the binary host address must be transformed into a modulo 3 address, in FIG. 4, the conversion is a simple shift and add binary remapping.

Another advantage of the present invention may be best illustrated using, as a specific example, the parameters of a typical display system. Since other examples are considered, the following example will be referred to as Case I:

Case I

Assumptions: 256 K×4b memory chips 1K×768 framebuffer, 60 Hz display at 15 ns/pixel, 8 bits/pixel, 2 bits/overlay value.

| | Traditional | Interleaved |
|---|---|---|
| # memory chips | 8 | 8 |
| video port cycle | 45 ns | 48 ns |
| read/write pixels/cycle | 3 | 4 |
| read/write overlays/cycle | 3 | 16 |
| off-screen memory bytes | 0 | 64 K |

The off-screen memory bytes referred to in the above table are memory bytes outside of the address range of the display data, and therefore are readily accessible for other purposes such as, by way of example, font storage. In comparison, in the traditional memory organization, the same 64K is distributed throughout the address range of the display information as the two unused bits of each thirty-two bit memory location, making the same substantially useless for other purposes.

A second example is a case wherein eight bits of image data per pixel and four bits of overlay per pixel are used. Here the pixel data and overlay data is considered organized in a sixty-four bit wide memory as shown in FIG. 7*c,* of course, being played back sequentially as shown in FIG. 7*d.* In essence, this is essentially twice the thirty-two bit case of FIG. 4. Such an organization is appropriate for a higher resolution display operating at the same memory access rate as the first case. If on the other hand, the present invention is applied to the second case, two address locations will store the image pixel data and the third the associated overlay image data. The following table presents the parameters for this second case:

Case II

Assumptions: 256 K×4b memory chips 1280×1 K framebuffer, 60 Hz display at 9 ns/pixel, 8 bits/pixel, 4 bits/overlay value.

| | Traditional | Interleaved |
|---|---|---|
| # memory chips | 15 | 16 |
| video port cycle | 45 ns | 48 ns |
| read/write pixels/cycle | 5 | 8 |
| read/write overlays/cycle | 5 | 16 |
| off-screen memory bytes | 0 | 128 K |

In simplifying the host address to framebuffer address to a shift and add remapping, an additional memory chip is required; in the process, the modulo five conversion necessary for the example in FIGS. 7*a* and 7*b* is no longer necessary. As before, memory speed requirements are reduced somewhat, and even though an additional memory chip is required, an off-screen memory address space equal to the full capacity of the extra chip (th8 pixels,8 pixels,ough not resident in one chip alone) is now available.

Finally consider as Case III the similar example as Case II but with two bits of overlay and two bits of clip plane per eight bit image data per pixel. The 64 bit wide memory 5 fetch interleaved pattern consists of a single fetch of 32 overlay values (each two bits), followed by four fetches of 8 pixels each. In this case, the clip plane data is placed in a single, contiguous block at one end of the memory space. This can be done because the clip plane data need not be displayed; as a result the five cycle interleaved pattern now has a more relaxed video cycle timing. This results in the following:

Case III

Assumptions: 256 K×4b memory chips 1280×1 K framebuffer, 60 Hz display at 9 ns/pixel, 8 bits/pixel, 2 bits/overlay value, 2 bits/clip plane.

| | Traditional | Interleaved |
|---|---|---|
| # memory chips | 15 | 16 |
| video port cycle | 45 ns | 57.6 ns |
| read/write pixels/cycle | 5 | 8 |
| read/write overlays/cycle | 5 | 32 |
| read/write clip plane/cycle | 5 | 32 |
| off-screen memory bytes | 0 | 128 K |

There has been described new and unique memory systems and memory organizations therefor for raster scan display systems. While certain preferred embodiments of the invention have been disclosed and described herein, it will be understood by those skilled in the art that various changes in form and detail may be made therein without departing from the spirit and scope of the invention.

I claim:

1. A computer-implemented method of storing and retrieving pixel data and overlay data of a plurality of pixels, comprising the steps of:

(A) storing in a plurality of memory address locations of a first memory device, either the pixel data of M pixels or the overlay data of N pixels, wherein the pixel data and the overlay data are stored in separate interleaving memory address locations of the first memory device, and wherein M is a non-zero integer and N is an integer multiple of M; and (B) performing a plurality of memory access cycles to access the plurality of memory address locations to obtain the pixel data and the overlay data of the N pixels, one memory address location being accessed per memory access cycle such that either the pixel data of M pixels or the overlay data of N pixels is obtained during each of the plurality of memory access cycles.

2. The computer-implemented method of claim 1, wherein the plurality of memory address locations accessed during the step of performing the plurality of memory access cycles equals N/M plus one.

3. The computer-implemented method of claim 1, wherein M equals four and N equals sixteen.

4. The computer-implemented method of claim 1, wherein M equals eight and N equals thirty-two.

5. The method of claim 1, wherein the step of storing in a plurality of memory address locations further comprises the steps of:

(i) storing the overlay data of the N pixels in a first address location;

(ii) storing the pixel data of the N pixels in N/M address locations adjacent to the first address location;

(iii) repeating the steps (i) and (ii) to store the pixel data and the overlay data of additional pixels of the plurality of pixels.

6. An apparatus for storing and retrieving pixel data and overlay data of N pixels, comprising:

a first memory device having a plurality of address locations configured to store either the pixel data of M pixels or the overlay data of the N pixels, wherein the pixel data and the overlay data are stored in separate interleaving memory address locations in said first memory device, wherein M is a non-zero integer and N is an integer multiple of M; and a memory access circuit coupled to the memory, the memory access circuit configured to access a plurality of memory address locations to obtain the pixel data and the overlay data of the N pixels, wherein the memory access circuit is further configured to access one memory address location per memory access cycle such that either the pixel data of M pixels or the overlay data of N pixels is obtained during a memory access cycle.

7. The apparatus of claim 6, wherein the plurality of memory address locations accessed by the memory access circuit is equal to N/M plus one

8. The apparatus of claim 6, wherein M equals four and N equals sixteen.

9. The apparatus of claim 6, wherein M equals eight and N equals thirty-two.

10. The apparatus of claim 6, wherein the memory is further configured to store the overlay data of the N pixels in a first address location and store the pixel data of the N pixels in N/M address locations adjacent to the first address location.

11. A computer-readable medium having stored thereon a plurality of instruction including a first set of instructions for storing and retrieving pixel data and overlay data of N pixels, the first set of instructions, when executed by a processor, cause said processor to perform the steps of:

(A) storing in a plurality of memory address locations of a first memory device, either the pixel data of M pixels or the overlay data of N pixels, wherein the pixel data and the overlay data are stored in separate interleaving memory address locations of the first memory device, and wherein M is a non-zero integer and N is an integer multiple of M; and (B) performing a plurality of memory access cycles to access the plurality of memory address locations to obtain the pixel data and the overlay data of the N pixels, one memory address location being accessed per memory access cycle such that either the pixel data of M pixels or the overlay data of N pixels is obtained during each of the plurality of memory access cycles.

12. The computer-readable medium of claim 11, wherein the plurality of memory address locations accessed during the step of performing the plurality of memory access cycles equals N/M plus one.

13. The computer-readable medium of claim 11, wherein M equals four and N equals sixteen.

14. The computer-readable medium of claim 11, wherein M equals eight and N equals thirty-two.

15. The computer-readable medium of claim 11, wherein the first set of instruction further include additional instructions, which when executed by the processor, cause said processor to perform the additional steps of:

(i) storing the overlay data of the N pixels in a first address location;

(ii) storing the pixel data of the N pixels in N/M address locations adjacent to the first address location;

(iii) repeating the steps (i) and (ii) to store the pixel data and the overlay data of additional pixels of the plurality of pixels.

* * * * *